US008624506B2

(12) United States Patent
Tokura

(10) Patent No.: US 8,624,506 B2
(45) Date of Patent: Jan. 7, 2014

(54) LIGHTING DEVICE

(75) Inventor: Atsushi Tokura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 138 days.

(21) Appl. No.: 13/376,149

(22) PCT Filed: Sep. 18, 2009

(86) PCT No.: PCT/JP2009/004725

§ 371 (c)(1),
(2), (4) Date: Dec. 2, 2011

(87) PCT Pub. No.: WO2010/140197

PCT Pub. Date: Dec. 9, 2010

(65) Prior Publication Data

US 2012/0091899 A1 Apr. 19, 2012

(30) Foreign Application Priority Data

Jun. 4, 2009 (JP) ..... 2009-135438

(51) Int. Cl.
*H05B 37/02* (2006.01)

(52) U.S. Cl.
USPC ..... 315/152; 315/86; 315/294

(58) Field of Classification Search
USPC ..... 315/150–152, 155, 157, 362, 86, 294, 315/161
See application file for complete search history.

(56) References Cited

U.S. PATENT DOCUMENTS

| | | | | |
|---|---|---|---|---|
| 6,317,034 | B1 * | 11/2001 | Issa et al. | 340/426.25 |
| 8,248,360 | B2 * | 8/2012 | Nanbu | 345/102 |
| 8,344,993 | B2 * | 1/2013 | Kanechika et al. | 345/102 |
| 2012/0098432 | A1 * | 4/2012 | Recker et al. | 315/86 |

FOREIGN PATENT DOCUMENTS

| | | | |
|---|---|---|---|
| JP | 10-106314 | A | 4/1998 |
| JP | 2002-352994 | A | 12/2002 |
| JP | 2004-103443 | A | 4/2004 |
| JP | 2005-176257 | A | 6/2005 |
| JP | 2005-268159 | A | 9/2005 |
| JP | 2007-189004 | A | 7/2007 |
| JP | 2008-206086 | A | 9/2008 |

* cited by examiner

*Primary Examiner* — James H Cho
(74) *Attorney, Agent, or Firm* — Birch, Stewart, Kolasch & Birch, LLP

(57) ABSTRACT

A remote control light receiver receives the infrared rays from an infrared LED incorporated in a remote control unit operated by the user, extracts the signal transmitted from the remote control unit, and outputs the extracted signal to a control microcomputer. The carrier frequency of the signal transmitted from the remote control unit is 38 kHz. A PWM control circuit performs PWM control by using an arbitrary PWM frequency within a range of 300 Hz to 3 kHz. By separating the PWM frequency and the frequency (carrier frequency) of the signal for remote control into different bands, the signal for remote control can be restrained from being affected by the turning on of the light source by PWM control, whereby remote control can be prevented from malfunctioning.

12 Claims, 18 Drawing Sheets

SIGNAL TRANSMITTING END
(REMOTE CONTROL UNIT)

SIGNAL RECEIVING END
(REMOTE CONTROL LIGHT RECEIVER OUTPUT)

LIGHTING DEVICE

This application is the national phase under 35 U.S.C. §371 of PCT International Application No. PCT/JP2009/004725 which has an International filing date of Sep. 18, 2009 and designated the United States of America.

BACKGROUND

1. Technical Field

The present invention relates to a lighting device having a light source such as a light emitting diode, and more particularly, relates to a lighting device in the form of an electric light bulb.

2. Description of Related Art

In recent years, lighting devices with light emitting diodes (LEDs) as the light source have been developed for various uses, and have been replacing lighting devices using conventional light sources such as an incandescent light bulb and a fluorescent lamp. Moreover, a lighting device has been developed that has a remote control function by means of a remote terminal such as a remote control unit in order to adjust the light source to the desired brightness and adjust the lighting condition. Moreover, many lighting devices using a light emitting diode as the light source adopt a switching circuit of the PWM control method or the like in order to adjust the brightness of the light source.

As a lighting device having the remote control function, for example, a fluorescent lamp lighting device having an infrared remote control function has been disclosed in which by providing an electric filter on the transmission line of the electric output of infrared receiving means, even when an infrared ray with a high-intensity argon spectrum that is prone to be generated when the fluorescent lamp is activated in a low-temperature atmosphere is received, the infrared receiver can be prevented from malfunctioning by blocking the received infrared ray by attenuating it with the electric filter (see Japanese Patent Application Laid-Open No. 2005-268159).

SUMMARY

However, although the lighting device of Japanese Patent Application Laid-Open No. 2005-268159 is capable of preventing interference between the infrared signal for remote control and the infrared ray generated from the fluorescent lamp, there is no disclosure as to the case of a lighting device using not a fluorescent lamp but a light emitting diode as the light source. Since many lighting devices using a light emitting diode as the light source adopt a switching circuit of the PWM control method or the like, there is a possibility that interference with the infrared signal for remote control occurs.

The present invention is made in view of such circumstances, and an object thereof is to provide a lighting device capable of preventing remote control from malfunctioning.

A lighting device according to the present invention is characterized in that in a lighting device provided with a light source unit; a receiver that receives a signal for remote control; and a PWM driver that drives the light source unit according to the signal received by the receiver, the PWM driver is structured so as to perform driving by using a PWM frequency different from a frequency of the signal.

In the present invention, the PWM driver drives the light source by using a PWM frequency different from the frequency of the signal for remote control. The frequency of the signal for remote control is, for example, the carrier frequency for infrared-ray communication. That frequencies are different is that the frequency bands thereof are separated. By separating the PWM frequency and the frequency of the signal for remote control into different bands, the signal for remote control can be restrained from being affected by the turning on of the light source by PWM control, whereby remote control can be prevented from malfunctioning.

The lighting device according to the present invention is characterized in that the PWM frequency is made different by separating the frequency band thereof from the frequency of the signal to the extent that interference with the frequency of the signal does not readily occur.

In the present invention, the PWM frequency is made different by separating the frequency band thereof from the frequency of the signal for remote control to the extent that interference with the frequency of the signal for remote control does not readily occur. Thereby, the frequency bands of these are separated to restrain the signal for remote control from being affected by the turning on of the light source by PWM control, whereby remote control can be prevented from malfunctioning.

The lighting device according to the present invention is characterized in that the PWM frequency is a frequency where it is reduced that flickering of the light source unit is viewed.

In the present invention, the PWM frequency is a frequency where it is reduced that flickering of the light source unit is viewed. For example, when the light source unit is turned on at a frequency lower than substantially 300 Hz, flickering is viewed. Therefore, by setting the PWM frequency, for example, to 300 Hz or higher, the flickering of the light source unit can be prevented from being viewed.

The lighting device according to the present invention is characterized in that the frequency of the signal is substantially 38 kHZ, and the PWM frequency is 300 Hz to 3 kHz.

In the present invention, the frequency of the signal is substantially 38 kHz, and the PWM frequency is 300 Hz to 3 kHz. In infrared-ray communication, for example, the carrier frequency is 38 kHz, 40 kHz or the like. When the PWM frequency is higher than 3 kHz, as it approaches the carrier frequency for infrared-ray communication, the distance where remote control can be performed without any malfunction decreases. When the PWM frequency is lower than 300 Hz, flickering of the light source is viewed. By setting the PWM frequency to 300 Hz to 3 kHz, remote control using infrared rays can be prevented from malfunctioning.

The lighting device according to the present invention is characterized in that the receiver is provided so as to receive the signal from a side where light from the light source unit is emitted.

In the present invention, the receiver is provided so as to receive the signal from the side where light from the light source unit is emitted. Even when the receiver is provided on the light emitting side of the light source unit, remote control can be prevented from malfunctioning.

The lighting device according to the present invention is characterized in that the light source unit includes: a circuit board; and a plurality of light emitting diodes mounted on the circuit board so as to be separated in a circular pattern, and the receiver is provided substantially in the center of the plurality of light emitting diodes.

In the present invention, the light source unit includes the circuit board and the plurality of light emitting diodes mounted on the circuit board so as to be separated in a circular pattern. The receiver is provided substantially in the center of the plurality of light emitting diodes. Since the signal for remote control can be restrained from being affected by the turning on of the light source by PWM control and remote control can be prevented from malfunctioning, the lighting device can be reduced in size by providing the light emitting diodes around the periphery of the receiver.

According to the present invention, remote control can be prevented from malfunctioning.

The above and further objects and features of the invention will more fully be apparent from the following detailed description with accompanying drawings.

DETAILED DESCRIPTION

First Embodiment

Figure 1:
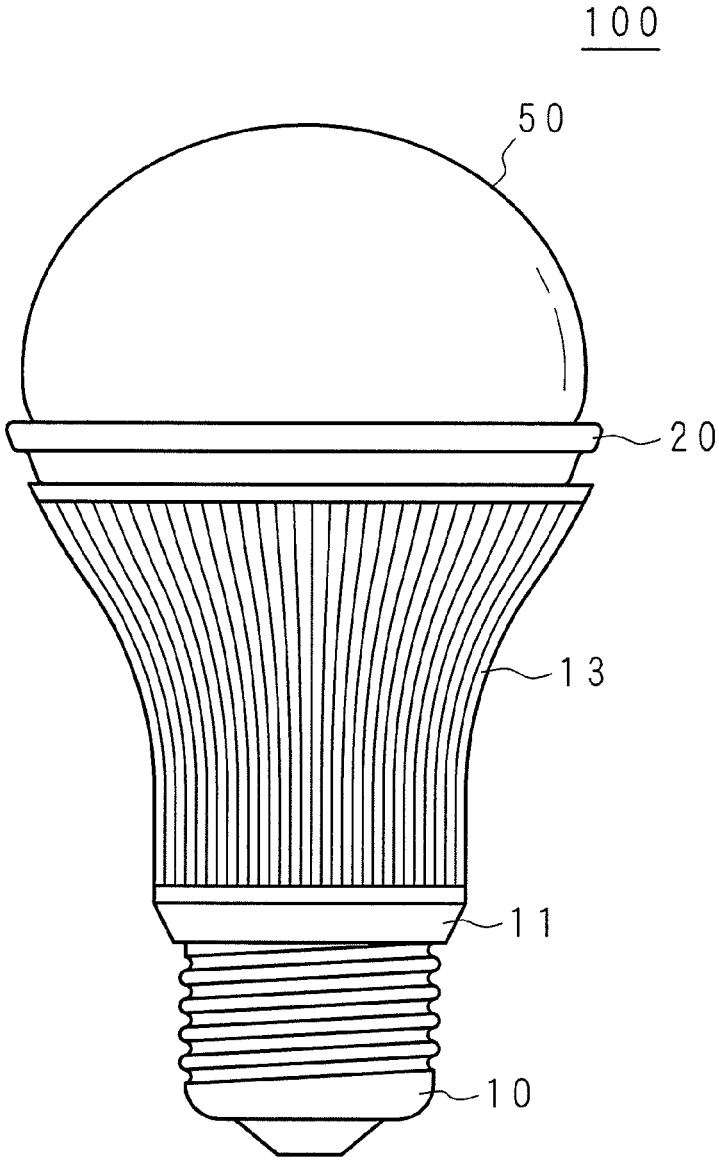
FIG. 1 is an external view of a lighting device of a first embodiment.
Figure 2:
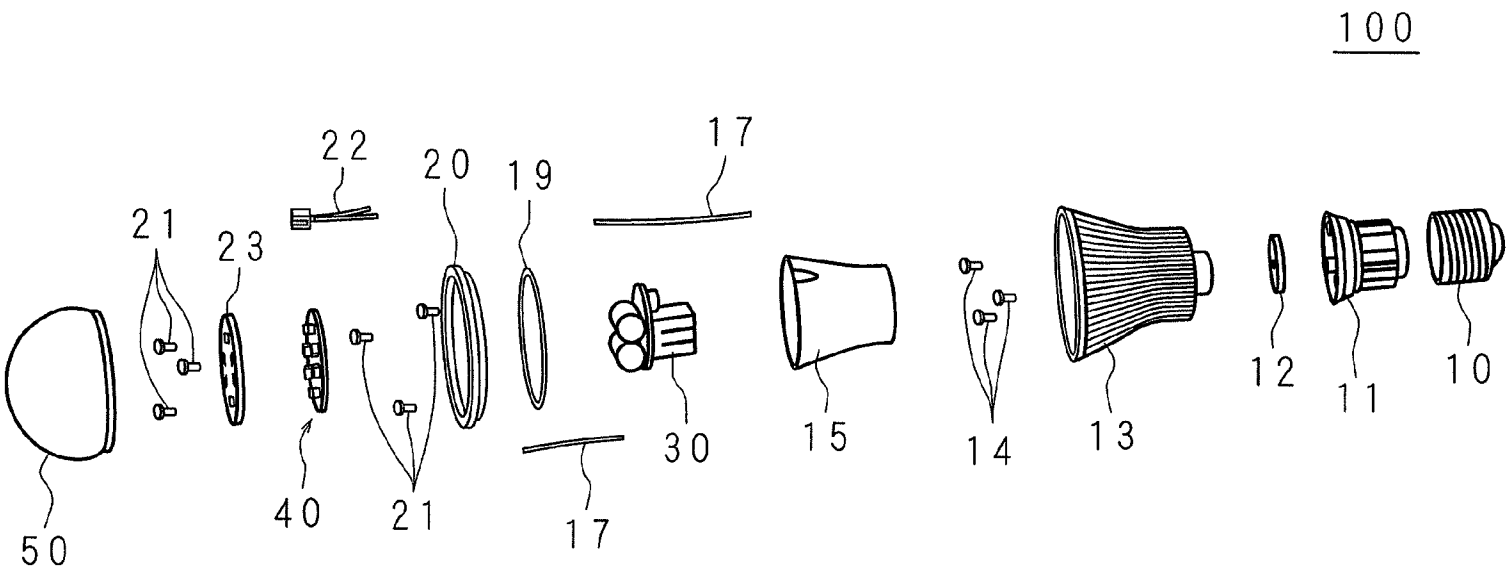
FIG. 2 is a relevant part exploded perspective view of the lighting device of the first embodiment.
Figure 3:
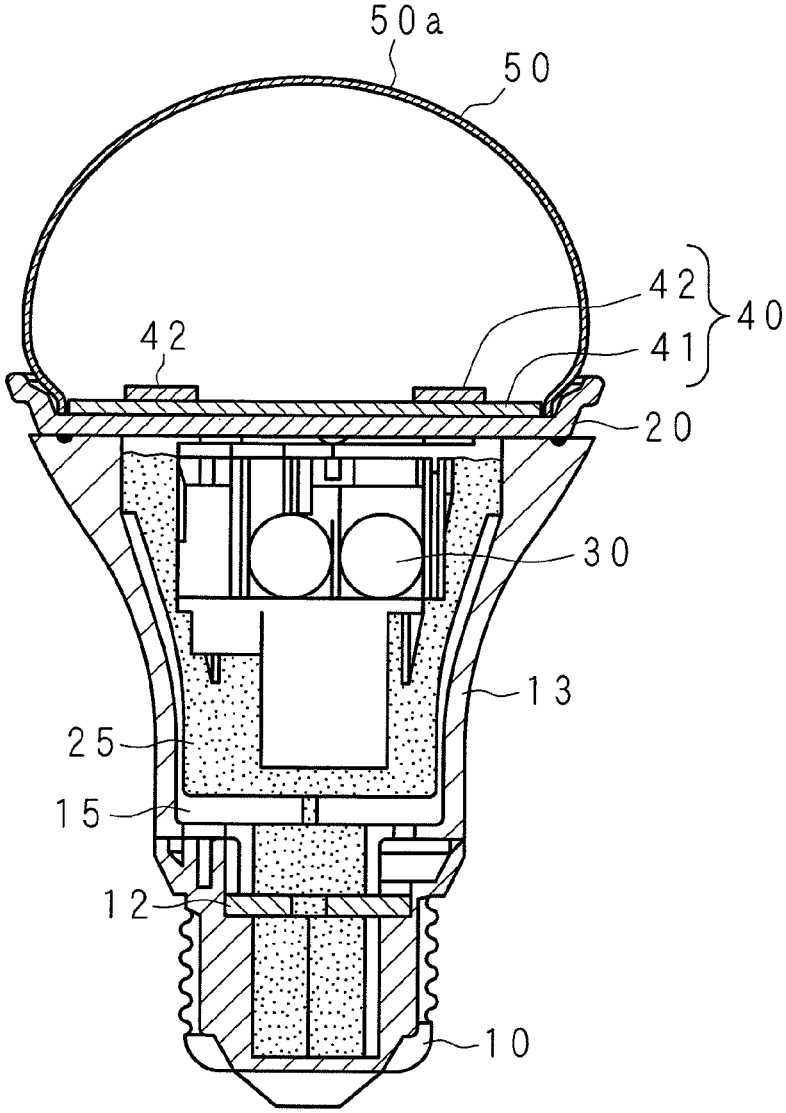
FIG. 3 is a cross-sectional view of the lighting device of the first embodiment.

Hereinafter, the present invention will be described based on the drawings showing embodiments thereof. FIG. 1 is an external view of a lighting device 100 of a first embodiment. FIG. 2 is a relevant part exploded perspective view of the lighting device 100 of the first embodiment. FIG. 3 is a cross-sectional view of the lighting device 100 of the first embodiment. As shown in FIG. 1, the lighting device 100 is an LED bulb of a bulb type of 40 W, 60 W, etc., and is provided with, when viewed externally: a cap 10 as a power source connector for electrically connecting the device to the commercial power source by inserting it into an external socket; a heat releasing portion 13; a coupling member 11 between the cap 10 and the heat releasing portion 13; a translucent portion 50 which is in the form of a hollow substantially hemispherical shell; and a disk-shaped heat releasing plate 20 on which LED modules described later are placed and that is thermally connected to the heat releasing portion 13.

As shown in FIGS. 2 and 3, to the heat releasing plate 20, a light source module 40 where the LED modules 42 are mounted on the surface of a board 41 is attached by screws 21. By applying a thermally conductive sheet or a highly thermally conductive resin between the light source module 40 and the heat releasing plate 20 in order to improve heat conduction efficiency, the heat generated by the light source module 40 can be released to the outside through the heat releasing plate 20 and the heat releasing portion 13.

The heat releasing portion 13 is made of, for example, a lightweight and highly thermally conductive metal such as aluminum, and is substantially cylindrical. Moreover, the heat releasing portion 13 has a plurality of heat releasing grooves on the outer peripheral surface of the cylinder, and the heat transmitted from the light source module 40 to the heat releasing portion 13 is released from the outer peripheral surface into the external air by using the heat releasing grooves. Between the heat releasing portion 13 and the heat releasing plate 20, a synthetic rubber waterproofing packing 19 is provided so that water does not enter the inside.

The heat releasing portion 13 has a cavity formed inside, and a power source unit 30 for supplying required electric power (voltage, current) to the LED modules 42 of the light source module 40 through a wiring 22 and an accommodating portion 15 for accommodating the power source unit 30 are disposed inside the heat releasing portion 13. Moreover, power wires 17 for supplying commercial power to the power source unit 30 are provided between the power source unit 30 and the cap 10.

Between the heat releasing portion 13 and the coupling member 11, a synthetic rubber waterproofing ring member 12 is provided so that water does not enter the inside, and the heat releasing portion 13 and the coupling member 11 are secured by screws 14.

Moreover, as shown in FIG. 3, around the power source unit 30 accommodated in the accommodating portion 15, a highly conductive synthetic resin 25 (for example, polyurthane resin) is filled in order that the heat generated at the power source unit 30 is efficiently conducted to the heat releasing portion 13 and the cap 10. It is preferable that the synthetic resin 25 have high electrical insulation property, low water permeability and fire retardancy.

The synthetic resin 25 is filled into the heat releasing portion 13 under a condition where the electric wiring inside the heat releasing portion 13 is finished and the heat releasing portion 13 and the cap 10 are mechanically joined together. The synthetic resin 25 is in a liquid form when filled. After the synthetic resin 25 is filled, it is hardened at a required temperature. The hardened synthetic resin 25 sticks to the inner surface of the cap 10 and also sticks to the inner surface of the heat releasing portion 13. Thereby, the entrance of water from the junction of the cap 10 can be more reliably prevented.

Moreover, since the synthetic resin 25 has high electrical insulation property, the heat releasing portion 13 and the charging portion of the power source unit 30 can be reliably prevented from suffering an insulation breakdown to be short-circuited. Moreover, since the synthetic resin 25 has high thermal conductivity, the heat generated at the power source unit 30 is released not only from the heat releasing portion 13 but also from the cap 10 thermally connected through the synthetic resin 25, so that increase in the temperature of the power source unit 30 is suppressed and consequently, the reliability of the electric parts used in the power source unit 30 can be improved.

To the light emitting surface side of the light source module 40, a reflecting plate 23 is attached by the screws 21. In the reflecting plate 23, insertion holes of substantially the same size as that of the LED modules 42 are provided in positions corresponding to the positions where the LED modules 42 are disposed, and the reflecting plate 23 is attached under a condition where the LED modules 42 are inserted in the insertion holes. The reflecting plate 23 is not essential but may be omitted.

The translucent portion 50 is made of milky white glass, and secured to the heat releasing plate 20 with an adhesive. The translucent portion 50 is not limited to glass, but milky white polycarbonate resin or the like may be used. When the translucent portion 50 is made of polycarbonate resin, it can be screwed to the heat releasing plate 20 by being threaded.

A light diffusing member 50*a* for diffusing the light from the LED modules 42 (light source module 40) is added to the translucent portion 50. As the light diffusing member 50*a*, for example, a member is used that has a crystalline structure and the optical characteristics of which are, for example, being high in refractive index, being low in light absorptive capacity and being high in light scattering power. For example, a pigment having a crystalline structure such as a fluorescent substance may be added. The percentage of addition of the light diffusing member 50*a* is, for example, approximately several percent. As the fluorescent substance, for example, $3Ca_3(PO_4)_2Ca(F, Cl)_2SbMn$ may be used.

Thereby, when the LED modules 42 having a surface-emitting characteristic are used as the light source, even if the directivity of the light of the LED modules 42 is narrow, the light emitted from the LED modules 42 is diffused by the light diffusing member 50*a* when passing through the translucent portion 50, so that the light distribution characteristic can be widened with a simple structure. When the light diffusing member 50*a* is a fluorescent substance, a material may be used that diffuses light and is excited by the light to emit light. By the light diffusing member 50*a* itself emitting light, the light distribution can be more widened.

Moreover, since the translucent portion 50 is in the form of a hollow substantially hemispherical shell, a bulb-type lighting device can be provided that uses the LED modules 42 (light emitting diodes) and has a wide light distribution characteristic.

In particular, since the translucent portion 50 and the heat releasing plate 20 are joined together at a part where the diameter is slightly smaller than the maximum diameter of the translucent portion 50 in the form of a substantially hemispherical shell, the light emitted from the LED modules 42 passes from, of the surface of the translucent portion 50, a part from the junction of the translucent portion 50 and the heat releasing plate 20 to the maximum diameter, whereby the light is radiated also in a direction from the heat releasing portion 13 toward the cap 10 and consequently, the light distribution characteristic can be further widened.

Figure 4:
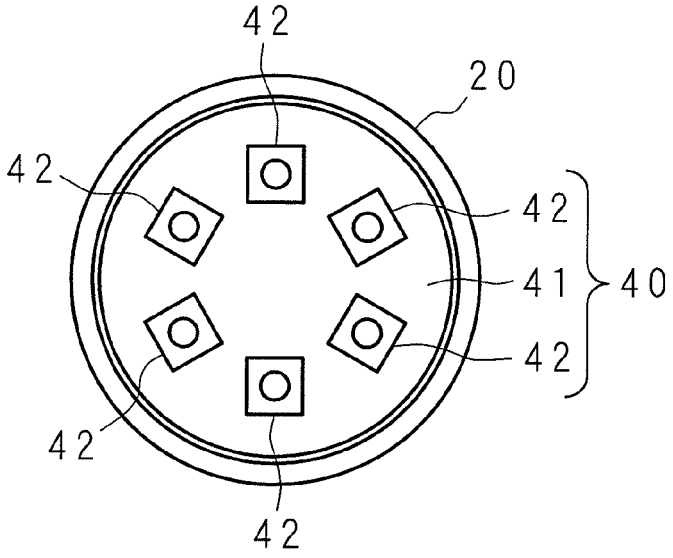
FIG. 4 is a plan view showing an example of the structure of the light emitting surface of a light source module.

FIG. 4 is a plan view showing an example of the structure of the light emitting surface of the light source module 40. In the light source module 40, on the substantially circular board 41 made of an aluminum alloy or the like, a plurality of LED modules 42 are arranged in a circular pattern so as to be separated at appropriate intervals. While six LED modules 42 are arranged in the example of FIG. 4, the number and arrangement of the LED modules 42 are not limited to those of the example of FIG. 4, but changing the number, arranging them in a substantially rectangular pattern and the like may be performed as appropriate according to the specifications and uses of the lighting device. The board 41 may be made of ceramic or the like.

As the LED modules 42, LED modules of a required emission color may be used; for example, LED modules of white may be used. The emission color is not limited to white, but may be neutral white or warm white.

Second Embodiment

While the light diffusing member 50*a* is added to the translucent portion 50 in the above-described example of FIG. 3, the present invention is not limited thereto. A structure may be adopted in which a light diffusing member is applied.

Figure 5:
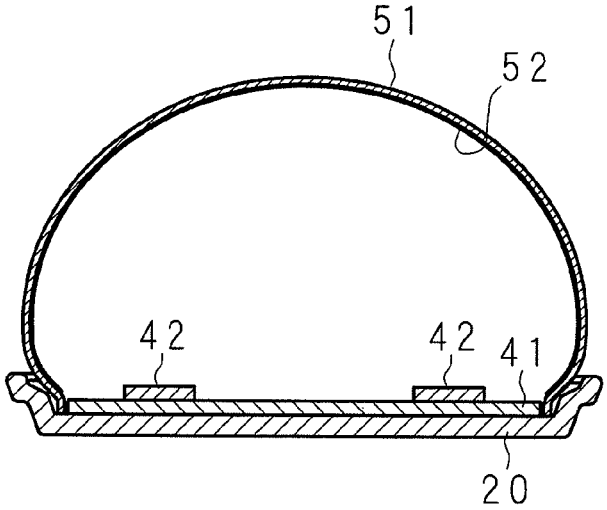
FIG. 5 is a relevant part cross-sectional view of a translucent portion of a second embodiment.

FIG. 5 is a relevant part cross-sectional view of a translucent portion 51 of the second embodiment. Like the translucent portion 50 of the first embodiment, the translucent portion 51 is made of milky white glass and secured to the heat releasing plate 20 with an adhesive. The translucent portion 51 is not limited to glass, but milky white polycarbonate resin or the like may be used. When the translucent portion 51 is made of polycarbonate resin, it can be screwed to the heat releasing plate 20 by being threaded.

To the inner side surface of the translucent portion 51, a light diffusing member 52 is applied (for example, baking application or electrostatic application). When baking application is performed, application is performed by, for example, applying the light diffusing member 52 which is a fluorescent substance to the surface of the translucent portion 51, heating it by increasing the temperature from room temperature to 100° for approximately 30 minutes, and then, further heating it at 150° for approximately 30 minutes. Moreover, as the light diffusing member 52, as in the first embodiment, for example, a member is used that has a crystalline structure and the optical characteristics of which are, for example, being high in refractive index, being low in light absorptive capacity and being high in light scattering power. The thickness of application of the light diffusing member 52 is approximately 1 mm to 2 mm. Since light is not readily transmitted if the thickness of the light diffusing member 52 is too thick, by setting the thickness within the above-mentioned range, light can be diffused while being transmitted. Thereby, when the LED modules 42 having a surface-emitting characteristic are used as the light source, even if the directivity of the light of the LED modules 42 is narrow, the light emitted from the LED modules 42 is diffused by the light diffusing member 52 when passing through the translucent portion 51, so that the light distribution characteristic can be widened with a simple structure. Depending on the material and composition of the light diffusing member 52, the application thickness is not limited to the range of 1 mm to 2 mm, but may be, for example, approximately several tens of um.

While the light diffusing member 52 is applied to the inner side surface of the translucent portion 51 in the example of FIG. 5, the present invention is not limited thereto, but the light diffusing member 52 may be applied to the outer side surface of the translucent portion 51. Alternatively, the translucent portion 51 may have a double structure where a layer formed of the light diffusing member 52 is sandwiched in between to form the translucent portion 51.

Third Embodiment

While the lighting device 100 has the structure of an LED bulb having a specific emission color in the above-described first and second embodiments, the lighting device 100 may be provided with a light control function. In a third embodiment, a structure can be provided in which a light controller (not shown) is interposed on the power wire between the commercial power source and the lighting device 100 and the brightness of the illumination light of the lighting device 100 is adjusted by the light controller.

Figure 6:
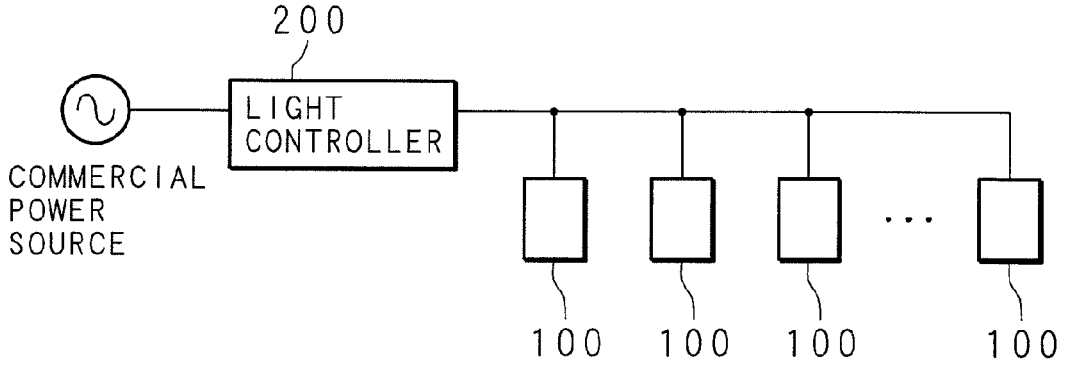
FIG. 6 is a schematic view showing an example of the installation of the lighting device of a third embodiment.

FIG. 6 is a schematic view showing an example of the installation of the lighting device 100 of the third embodiment. The commercial power source is provided with a light controller 200, and a plurality of lighting devices 100 are connected to the output side power wire of the light controller 200. As described above, by providing the lighting device 100 with a bulb shape incorporating the LED modules 42, existing light bulbs can be replaced with the lighting device 100. In FIG. 6, by turning a light control knob (operation switch or the like) of the light controller 200, the lighting devices 100 installed in a wide range can be light-controlled by one operation. Moreover, the lighting devices 100 may be light-controlled by transmitting a signal to the light controller 200 by using a remote control unit for remote control. The lighting device 100 may have a structure in which the light controller 200 is incorporated by being accommodated in the accommodating portion 15 inside the heat releasing portion 13 like the power source unit 30.

Next, the light control method in the third embodiment will be described. The light controller 200 outputs a phase-controlled AC voltage to each lighting device 100 according to the degree of light control (for example, 100% to 25%). Each lighting device 100 detects the phase angle of the input voltage, and turns on the LED modules 42 with the light quantity corresponding to the phase angle. For example, when the phase angle is small, the current passed through the LED modules 42 is increased, and as the phase angle increases, the current passed through the LED modules 42 is decreased, whereby light control according to the phase angle can be performed.

Descriptions of the parts similar to those of the first and second embodiments (for example, the structures shown in FIGS. 1 to 5) are omitted. Since the lighting device 100 of the third embodiment is capable of precisely performing light control also for phase-controlled AC voltages as described above, it can replace existing light bulbs adopting the light control method by phase control or may be used together with existing bulbs.

Fourth Embodiment

While the first and the second embodiment has no light control function and the third embodiment has a structure in which light control is performed by using an external light controller, a structure may be provided in which the function of performing not only light control but also color control (adjusting the emission color to a desired color) by using a remote control unit for remote control is provided.

Figure 7:
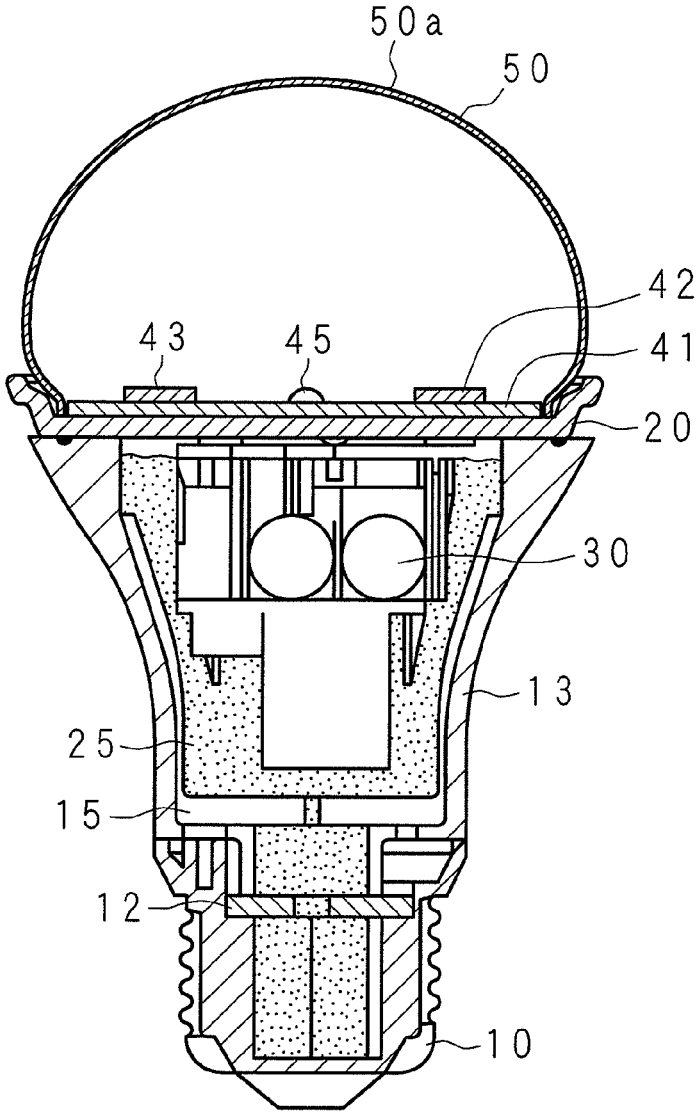
FIG. 7 is a cross-sectional view of the lighting device of a fourth embodiment.
Figure 8:
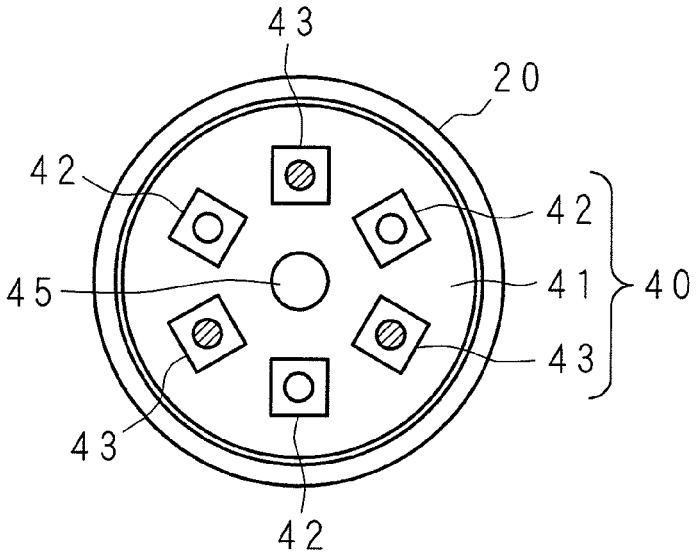
FIG. 8 is a plan view showing an example of the structure of the light emitting surface of the light source module of the fourth embodiment.

FIG. 7 is a cross-sectional view of the lighting device 100 of the fourth embodiment. FIG. 8 is a plan view showing an example of the structure of the light emitting surface of the light source module 40 of the fourth embodiment. A difference from the first to third embodiments is that LED modules 42 and 43 of different light emission colors, a remote control light receiver 45 that receives signals from a remote terminal such as a remote control unit, and the like are provided. Hereinafter, details of the fourth embodiment will be described.

As shown in FIGS. 7 and 8, in the light source module 40, the LED modules 42 and 43 of different emission colors are alternately disposed in a circular pattern so as to be separated at appropriate intervals on the substantially circular board 41 made of an aluminum alloy or the like. While the numbers of LED modules 42 and 43 used are each three in the example of FIG. 8, the number and arrangement of the LED modules 42 and 43 are not limited to those of the example of FIG. 8, but changing the numbers, arranging them in a substantially rectangular pattern and the like may be performed as appropriate according to the specifications and uses of the lighting device. The board 41 may be made of ceramic or the like.

The LED modules 42 are capable of emitting, for example, white light, and the LED modules 43 are capable of emitting, for example, warm white light. The light emission colors are not limited thereto, but may be other colors such as red, green and blue.

In the center of the substantially circular substrate 41, the remote control light receiver 45 is disposed. As shown in FIG. 8, in the bulb-type lighting device 100, the part that can be viewed under a condition where the lighting device 100 is attached to a lighting apparatus or the like is substantially only the translucent portion 50. For example, in order that the user performs a remote control operation with a remote control unit, it is necessary to provide the remote control light receiver 45 in a region viewed as the translucent portion 50. By providing the LED modules 42 and 43 around the remote control light receiver 45 so as to surround the remote control light receiver 45, the size of the lighting device 100 can be reduced.

Figure 9:
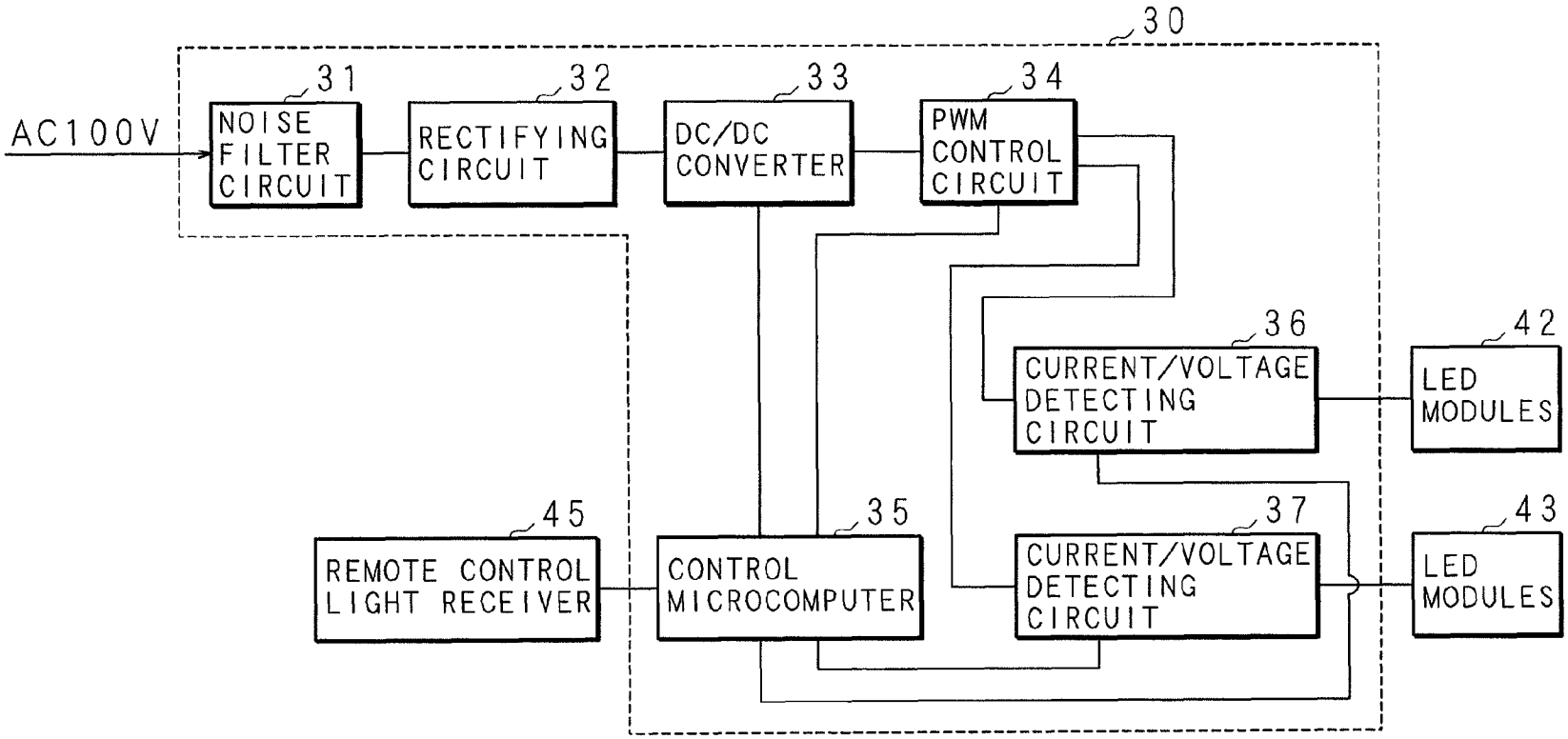
FIG. 9 is a block diagram showing the structure of a power source unit of the fourth embodiment.

FIG. 9 is a block diagram showing the structure of the power source unit 30 of the fourth embodiment. The power source unit 30 is provided with: a noise filter circuit 31 for removing noises entering from the commercial power source or the like; a rectifying circuit 32 that rectifies an AC voltage and converts it into a DC voltage; a DC/DC converter 33 that converts the DC voltage outputted from the rectifying circuit 32 into a required DV voltage; a PWM control circuit 34 as a PWM driver that controls the current supplied to the LED modules 42 and 43 by performing pulse-width modulation on the DC voltage outputted form the DC/DC converter 33; a control microcomputer 35 that controls the power source unit 30; a current/voltage detecting circuit 36 that detects the current flowing through the LED modules 42 and the voltage applied thereto; and a current/voltage detecting circuit 37 that detects the current flowing through the LED modules 43 and the voltage applied thereto.

The remote control light receiver 45 receives the infrared ray from the infrared LEDs incorporated in a remote control unit (not shown) operated by the user, extracts the signal transmitted from the remote control unit, and outputs the extracted signal to the control microcomputer 35. The signal transmitted from the remote control unit is, for example, for turning on and off, light-controlling (for example, 70%, 50%, 30%) and color-controlling (for example, adjusting the emission color in steps from white to warm white) the light source.

Figure 10:
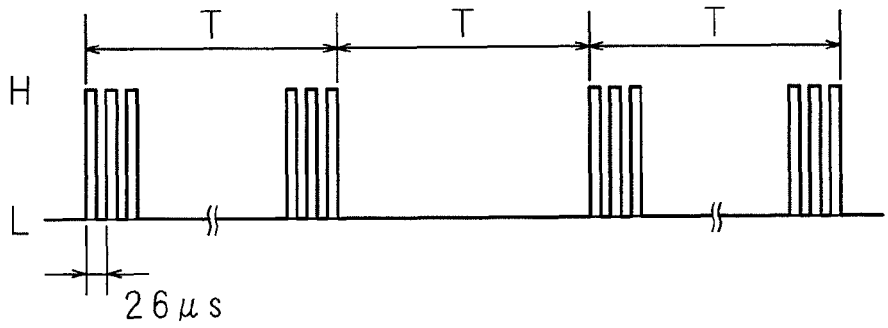
FIG. 10 is an explanatory view showing an example of the signal received by a remote control light receiver.
Figure 10:
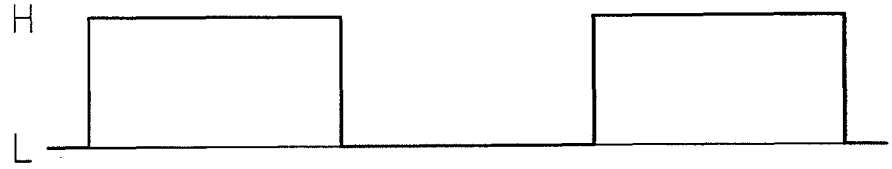

FIG. 10 is an explanatory view showing an example of the signal received by the remote control light receiver 45. FIG. 10 shows a signal transmitted from the remote control unit which is the signal transmitting end, that is, a signal received by the remote control light receiver 45, and shows the output condition of the remote control light receiver 45. As shown in FIG. 10, the carrier frequency of the signal transmitted from the remote control unit is 38 kHz, and the cycle thereof is approximately 26 μs. The carrier frequency is not limited to 38 kHz but may be a different frequency such as 40 kHz.

On the remote control unit side, when the blinking of the infrared LED is repeated at intervals of 26 μs for a predetermined time T, the remote control light receiver 45 outputs a high-level (H) electric signal. Moreover, on the remote control side, when the infrared LED is off for the predetermined time T, the remote control light receiver 45 outputs a low-level (L) electric signal.

The control microcomputer 35 outputs a control signal for turning on and off, light-controlling and color-controlling the light source, to the DC/DC converter 33 and the PWM control circuit 34 based on the signal outputted from the remote control light receiver 45.

Moreover, the control microcomputer 35 outputs a control signal for making the light source stay on with a predetermined light quantity, to the DC/DC converter 33 and the PWM control circuit 34 based on the detection result outputted from the current/voltage detecting circuits 36 and 37.

The PWM control circuit 34 obtains the control signal outputted from the control microcomputer 35, and performs PWM control according to the obtained control signal on the LED modules 42 and 43. The PWM control circuit may be provided in each of the LED modules 42 and 43.

The frequency band of the PWM control circuit 34 is a frequency band where interference does not readily occur with the carrier frequency (for example, 38 kHz) of the signal transmitted by the remote control unit through infrared rays. For example, PWM control can be performed by using an arbitrary PWM frequency within a range of 300 Hz to 3 kHz. Hereinafter, the relationship between the PWM frequency and the carrier frequency of the signal light-received by the remote control light receiver 45 will be described.

Figure 11:
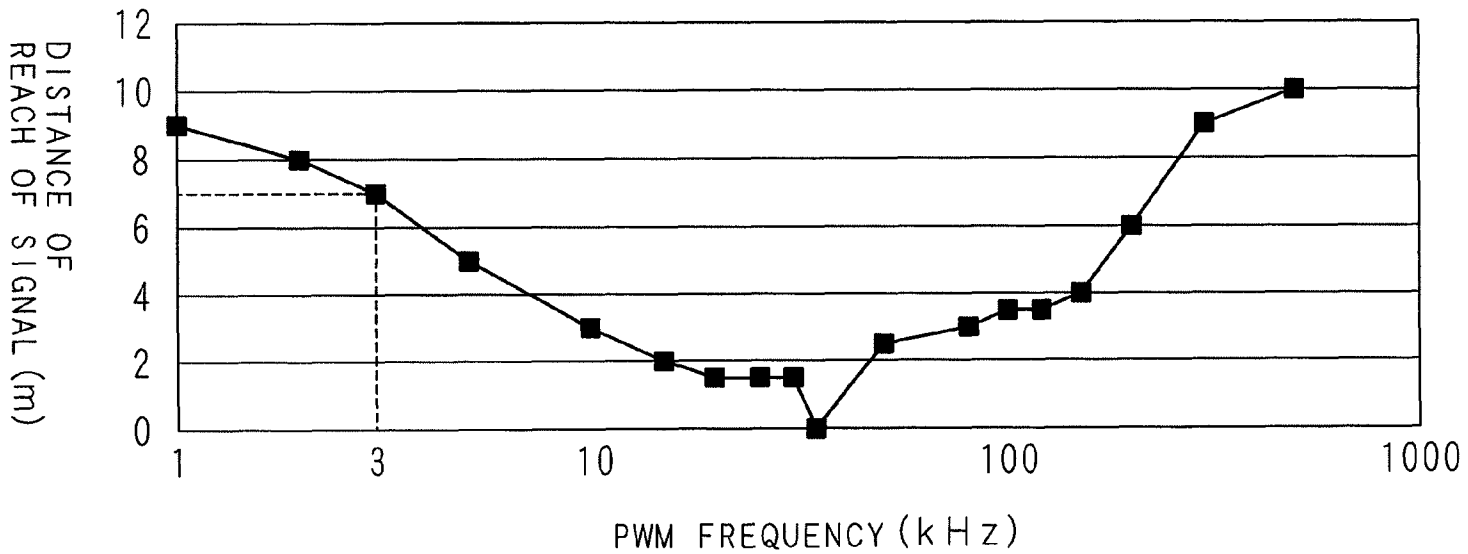
FIG. 11 is an explanatory view showing the relationship between a PWM frequency and the distance of reach of the signal from a remote control unit.

FIG. 11 is an explanatory view showing the relationship between the PWM frequency and the distance of reach of the signal from the remote control unit. In FIG. 11, the horizontal axis represents the PWM frequency, and the vertical axis represents the distance of reach of the signal from the remote control unit. The distance of reach is the distance between the remote control unit and the remote control light receiver 45 where the signal from the remote control unit can be reliably received, and it is desirable that it is 7 m or longer for practical use.

As is apparent from FIG. 11, when the PWM frequency is approximately 3 kHz or lower, a distance of reach of 7 m or longer can be secured. When the PWM frequency is 200 kHz or higher, a distance of reach of 7 m or longer can be secured.

However, when the PWM frequency is 300 Hz or lower, flickering of the light source is viewed. Therefore, it is desirable that the PWM frequency be within a range of 300 Hz to 3 kHz. By thus separating the PWM frequency and the frequency (carrier frequency) of the signal for remote control into different bands, the signal for remote control is restrained from being affected by the turning on of the light source by PWM control, so that remote control can be prevented from malfunctioning. In particular, by setting the PWM frequency to 300 Hz to 3 kHz, remote control using infrared rays can be prevented from malfunctioning. Consequently, even if the remote control light receiver 45 is provided so as to receive the infrared signal for remote control from the side where light is emitted from the LED modules 42 and 43, remote control using infrared rays can be prevented from malfunctioning.

Moreover, by disposing the remote control light receiver 45 substantially in the center of the LED modules 42 and 43 arranged in a circular pattern, the size of the lighting device can be reduced, and the signal for remote control can be restrained from being affected by the turning on of the light source by PWM control, whereby remote control can be prevented from malfunctioning.

While the PWM frequency can be set to not less than 200 kHz, since there is a possibility that heat generation by a switching element such as an FET used for the PWM control circuit 34 increases, the above-mentioned range of 300 Hz to 30 kHz is more desirable.

Figure 12:
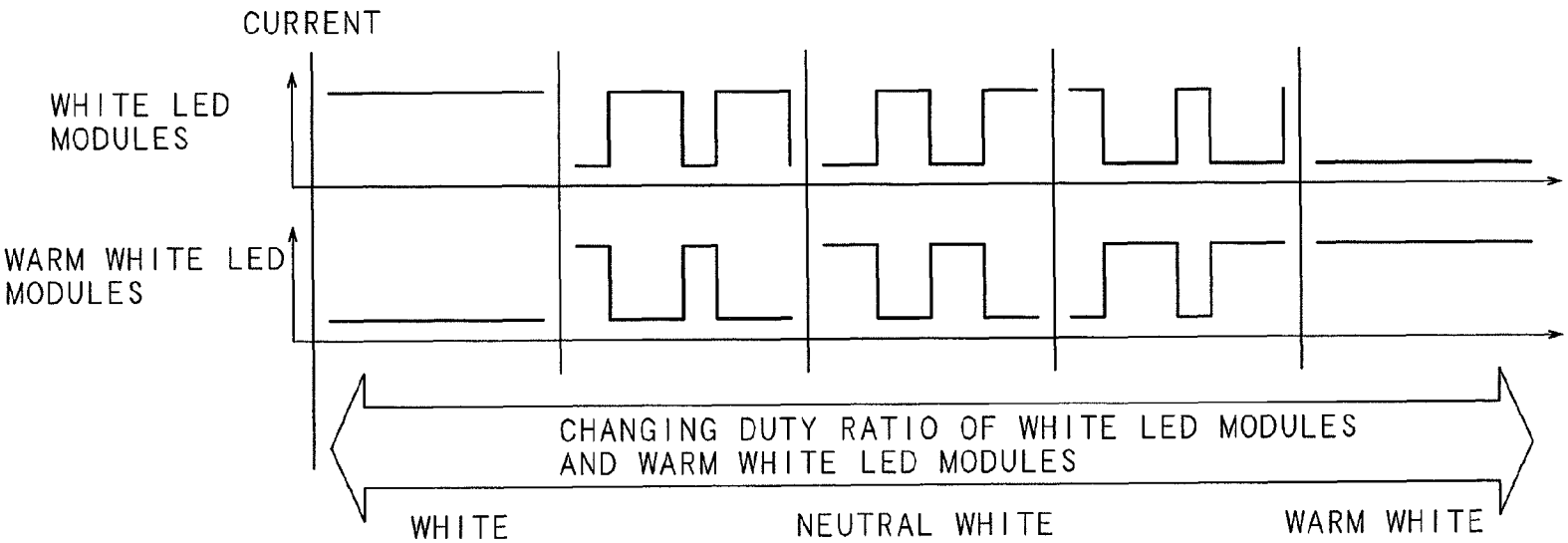
FIG. 12 is an explanatory view showing an example of the color control of the lighting device of the fourth embodiment.

Next, the color control method of the lighting device 100 of the fourth embodiment will be described. FIG. 12 is an explanatory view showing an example of the color control of the lighting device 100 of the fourth embodiment. In FIG. 12, the horizontal axis represents time, and the vertical axis represents the current flowing through the LED modules 42 and 43. The LED modules 42 are white LED modules, and the LED modules 43 are warm white LED modules.

When accepting an operation to change the illumination color (the overall emission color of the lighting device 100) to white through the remote control light receiver 45, as shown in FIG. 12, the control microcomputer 35 turns on the white LED modules (LED modules 42) at a duty ratio of 100%, and turns off the warm white LED modules (LED modules 43).

When accepting an operation to change the illumination color (the overall emission color of the lighting device 100) from white slightly to the warm white side through the remote control light receiver 45, as shown in FIG. 12, the control microcomputer 35 turns on the white LED modules (LED modules 42) at a duty ratio of 75%, and turns on the warm white LED modules (LED modules 43) at a duty ratio of 25%. Here, the duty ratio is a ratio of the period, during which current is passed through the LED modules, of one cycle. Under this condition, the illumination color becomes a color intermediate between white and neutral white.

When accepting an operation to change the illumination color (the overall emission color of the lighting device 100) to neutral white through the remote control light receiver 45, as shown in FIG. 12, the control microcomputer 35 turns on the white LED modules (LED modules 42) at a duty ratio of 50%, and turns on the warm white LED modules (LED modules 43) at a duty ratio of 50%. Under this condition, the illumination color becomes neutral white.

When accepting an operation to change the illumination color (the overall emission color of the lighting device 100) from neutral white slightly to the warm white side through the remote control light receiver 45, as shown in FIG. 12, the control microcomputer 35 turns on the white LED modules (LED modules 42) at a duty ratio of 25%, and turns on the warm white LED modules (LED modules 43) at a duty ratio of 75%. Under this condition, the illumination color becomes a color intermediate between neutral white and warm white.

When accepting an operation to change the illumination color (the overall emission color of the lighting device 100) to warm white through the remote control light receiver 45, as shown in FIG. 12, the control microcomputer 35 turns off the white LED modules (LED modules 42), and turns on the warm white LED modules (LED modules 43) at a duty ratio of 100%. Under this condition, the illumination color becomes warn white.

In the example of FIG. 12, the control microcomputer 35 performs control so that the LED modules 42 and 43 of different emission colors are not on at the same time (the lighting times, that is, the times during which PWM control is on do not overlap). That is, while the white LED modules are on, the warm white LED modules are off, and while the warn color LED modules are on, the white LED modules are off. Thereby, the emission color can be adjusted without the current supplied to the LED modules 42 and 43 being changed to a predetermined value (the value of the current supplied to the LED modules of one emission color) or higher.

In addition, by the PWM control, the illumination color can be changed to a desired emission color (color temperature) within a range of white, neutral white, warm white and the like by changing the ratio between the lighting times of the LED modules of the colors, so that an optimum illumination environment can be realized in accordance with the scene of use of the lighting device and the user's preferences.

Figure 13:
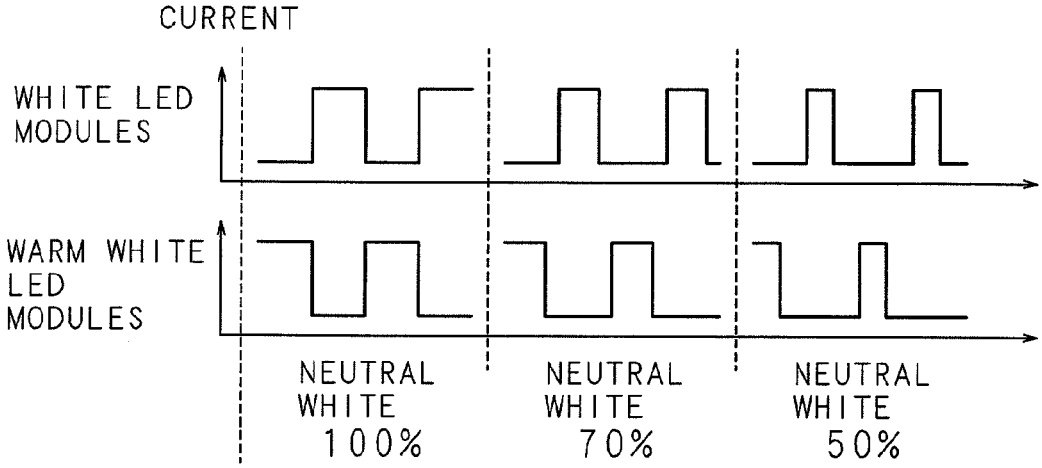
FIG. 13 is an explanatory view showing an example of the light control of the lighting device of the fourth embodiment.

Next, the light control method of the lighting device 100 of the fourth embodiment will be described. FIG. 13 is an explanatory view showing an example of the light control of the lighting device 100 of the fourth embodiment. In FIG. 13, the horizontal axis represents time, and the vertical axis represents the current flowing through the LED modules 42 and 43. The LED modules 42 are white LED modules, and the LED modules 43 are warm white LED modules.

When accepting an operation to change the brightness to full brightness (100% light control) after setting the illumination color, for example, to neutral white through the remote control light receiver 45, as shown in FIG. 13, the control microcomputer 35 turns on the white LED modules (LED modules 42) at a duty ratio of 50%, and turns on the warm white LED modules (LED modules 43) at a duty ratio of 50%. Under this condition, since the LED modules of any one of the colors are on over one cycle, light control is 100%.

When accepting an operation to slightly reduce the brightness, as shown in FIG. 13, the control microcomputer 35 turns on the white LED modules (LED modules 42) at a duty ratio of 35%, and turns on the warm white LED modules (LED modules 43) at a duty ratio of 35%. Under this condition, since the LED modules of any one of the colors are on and the period is 70% of one cycle, light control is 70%.

When accepting an operation to further reduce the brightness, as shown in FIG. 13, the control microcomputer 35 turns on the white LED modules (LED modules 42) at a duty ratio of 25%, and turns on the warm white LED modules (LED modules 43) at a duty ratio of 25%. Under this condition, since the LED modules of any one of the colors are on and the period is 50% of one cycle, light control is 50%. This applies to the other emission colors.

Figure 14:
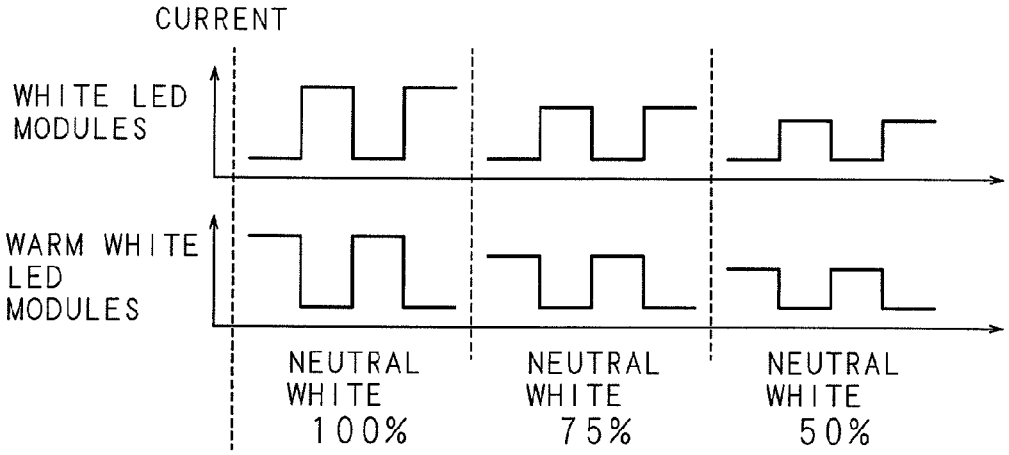
FIG. 14 is an explanatory view showing another example of the light control of the lighting device of the fourth embodiment.

As described above, the control microcomputer 35 performs light control by controlling the lengths of the lighting times of the light sources of different emission colors while making the ratio between the lighting times fixed. Thereby, color control and light control can be performed at the same time, so that a more optimum illumination environment can be realized in accordance with the scene of use of the lighting device 100 and the user's preferences. FIG. 14 is an explanatory view showing another example of the light control of the lighting device 100 of the fourth embodiment. In FIG. 14, the horizontal axis represents time, and the vertical axis represents the current flowing through the LED modules 42 and 43. The LED modules 42 are white LED modules, and the LED modules 43 are warm white LED modules.

When accepting an operation to change the brightness to full brightness (100% light control) after setting the illumination color, for example, to neutral white through the remote control light receiver 45, as shown in FIG. 14, the control microcomputer 35 passes a current of a predetermined value through the white LED modules (LED modules 42) and the warm white LED modules. Under this condition, light control is 100%. While the duty ratio is 50%, it is not limited thereto.

When accepting an operation to slightly reduce the brightness, as shown in FIG. 14, the control microcomputer 35 makes the current passed through the white LED modules (LED modules 42) and the warm white LED modules (LED modules 43) lower than the predetermined value. Under this condition, since the current flowing through the LED modules is 75% of the predetermined value, light control is 75%.

When accepting an operation to further reduce the brightness, as shown in FIG. 14, the control microcomputer 35 further reduces the current passed through the white LED modules (LED modules 42) and the warm white LED modules (LED modules 43). Under this condition, since the current flowing through the LED modules is 50% of the predetermined value, light control is 50%. This applies to the other emission colors.

As described above, the control microcomputer 35 performs light control by controlling the amounts of current supplied during the lighting times of the LED modules 42 and 43 of different emission colors while making the lengths of the lighting times fixed. Thereby, color control and light control can be performed at the same time, so that a more optimum illumination environment can be realized in accordance with the scene of use of the lighting device 100 and the user's preferences.

Fifth Embodiment

While the remote control light receiver 45 is provided on the surface of the board 41 in the above-described fourth embodiment, a structure may be provided in which the influence by the heat generated at the LED modules 42 and 43 being transmitted to the remote control light receiver 45 through the board 41 is prevented.

Figure 15:
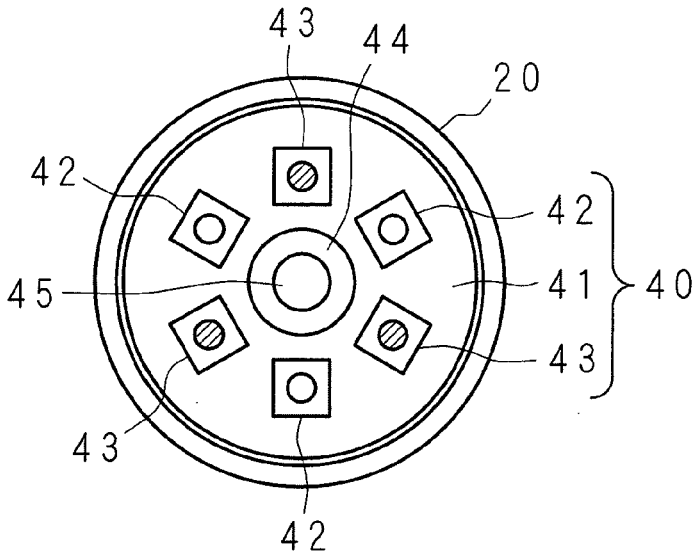
FIG. 15 is a plan view showing an example of the structure of the light emitting surface of the light source module of a fifth embodiment.
Figure 16:
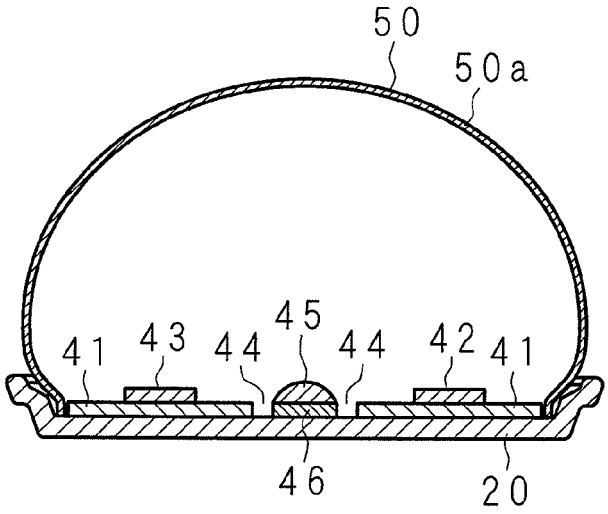
FIG. 16 is a relevant part cross-sectional view showing an example of the disposition of the remote control light receiver of the fifth embodiment.

FIG. 15 is a plan view showing an example of the structure of the light emitting surface of the light source module 40 of the fifth embodiment. FIG. 16 is a relevant part cross-sectional view showing an example of the disposition of the remote control light receiver 45 of the fifth embodiment. The board 41 of the light source module 40 has a circular hole 44 in the center. On the board 41, a plurality of LED modules 42 and 43 of different emission colors are alternately disposed at appropriate intervals in a circular pattern with the hole 44 at the center. The diameter of the hole 44 is larger than the size of the remote control light receiver 45.

The remote control light receiver 45 is disposed substantially in the center of the hole 44 so as to be separated from the board 41. The remote control light receiver 45 is attached onto the heat releasing plate 20, and is provided on a substrate 46 separated from the board 41.

As described above, the remote control light receiver 45 receiving external signals is provided so as to be thermally separated from the LED modules 42 and 43 and is separated physically, whereby the heat from the LED modules 42 and 43 can be prevented from being conducted to the remote control light receiver 45. Moreover, even when the remote control light receiver 45 and the LED modules 42 and 43 are physically connected together, by interposing the heat releasing plate 20 therebetween, the heat can be prevented from being conducted to the remote control light receiver 45 since the heat is released while it is being conducted from the LED modules 42 and 43 to the remote control light receiver 45. Consequently, the remote control light receiver 45 can be prevented from deteriorating and breaking down.

Moreover, since the remote control light receiver 45 is provided so as to be separated from the board 41 where the LED modules 42 and 43 are mounted, the heat generated at the LED modules 42 and 43 is not readily conducted to the remote control light receiver 45 through the board 41, so that the remote control light receiver 45 can be prevented from deteriorating and breaking down.

Figure 17:
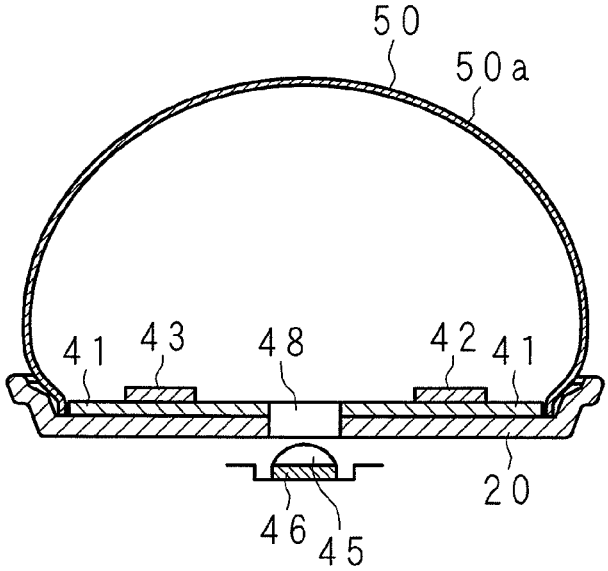
FIG. 17 is a relevant part cross-sectional view showing another example of the disposition of the remote control light receiver of the fifth embodiment.

FIG. 17 is a relevant part cross-sectional view showing another example of the disposition of the remote control light receiver 45 of the fifth embodiment. In the example of FIG. 17, a plurality of LED modules 42 and 43 are alternately mounted in a circular pattern so as to be separated from one another on one surface of the hole 44, the board 41 has an opening 48 substantially in the center of a region surrounded by the LED modules 42 and 43, and the remote control light receiver 45 provided on the other substrate 46 physically separated from the board 41 is disposed in the vicinity of the opening 48. The substrate 46 is supported by an appropriate support member. Thereby, since the remote control light receiver 45 can be provided substantially in the center of the region where the LED modules 42 and 43 are arranged without physically connected to the board 41 where the LED modules 42 and 43 are mounted, the remote control light receiver 45 can be provided on the light emitting surface of the lighting device 100, so that the size of the device can be reduced.

When the remote control light receiver 45 is provided in the vicinity of the opening 48, the remote control light receiver 45 may be provided in a position surrounded by the board 41 and the inner peripheral surface of the heat releasing plate 20 or may be provided in a position separated from the opening 48 toward the side of the power source unit 30 in a direction intersecting the direction of the plate surface of the board 41 and the heat releasing plate 20. Thereby, the remote control light receiver 45 can be further separated from the LED modules 42 and 43 and the board 41, so that the influence of the heat can be reduced.

Figure 18:
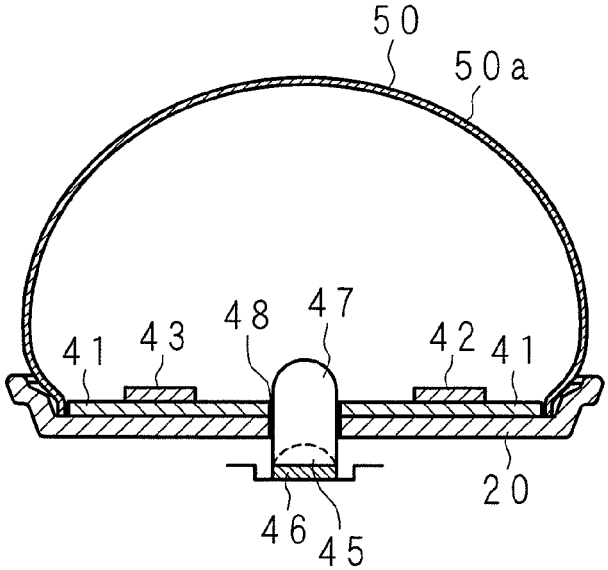
FIG. 18 is a relevant part cross-sectional view showing another example of the disposition of the remote control light receiver of the fifth embodiment.

FIG. 18 is a relevant part cross-sectional view showing another example of the disposition of the remote control light receiver 45 of the fifth embodiment. In the example of FIG. 18, a light directing member 47 for directing the infrared rays from the remote control unit to the remote control light receiver 45 is provided. The light directing member 47 is made of glass or synthetic resin and is substantially cylindrical. One side thereof has a curved surface (spherical surface) convex to the outside so that the light from the remote control unit is taken in, and the other side thereof has a curved surface concave to the outside in accordance with the shape of the remote control light receiver 45. Thereby, when a signal (infrared ray) is transmitted from the outside to the translucent portion 50 which is the light emitting surface of the lighting device 100, the signal can be reliably directed to the remote control light receiver 45. The above-mentioned other side (the end surface on the side of the remote control light receiver 45) of the light directing member 47 is not limited to a concave curved surface but may be plane.

As described above, according to the present invention, the signal for remote control can be restrained from being affected by the turning on of the light source by PWM control, whereby remote control can be prevented from malfunctioning.

While a bulb-type lighting device has been described in the above-described embodiments, the configuration of the lighting device is not limited to the bulb-type, but may be a different configuration. Moreover, while a lighting device having LED modules as the light source has been described, the light source is not limited to LED modules but may be a different light source such as organic EL as long as it is a light emitting element having surface emission.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A lighting device having a light source unit, a receiver that receives a signal for remote control, and a PWM driver that drives the light source unit according to the signal received by the receiver:

wherein the PWM driver is structured so as to perform driving by using a PWM frequency different from a frequency of the signal, wherein the light source unit includes:

a circuit board:

and a plurality of light emitting diodes mounted on the circuit board so as to be separated in a circular pattern, and the receiver is provided substantially in a center of the plurality of light emitting diodes.

2. The lighting device according to claim 1, wherein the frequency of the signal is substantially 38 kHZ, and the PWM frequency is 300 Hz to 3 kHz.

3. The lighting device according to claim 1, wherein the receiver is provided so as to receive the signal from a side where light from the light source unit is emitted.

4. A lighting device having a light source unit, a receiver that receives a signal for remote control, and a PWM driver that drives the light source unit according to the signal received by the receiver:

wherein the PWM driver is structured so as to perform driving by using a PWM frequency different from a frequency of the signal, wherein the PWM frequency is made different by separating a frequency band thereof from the frequency of the signal to an extent that interference with the frequency of the signal does not readily occur, wherein the light source unit includes:

a circuit board;

and a plurality of light emitting diodes mounted on the circuit board so as to be separated in a circular pattern, and the receiver is provided substantially in a center of the plurality of light emitting diodes.

5. The lighting device according to claim 4, wherein the frequency of the signal is substantially 38 kHZ, and the PWM frequency is 300 Hz to 3 kHz.

6. The lighting device according to claim 4, wherein the receiver is provided so as to receive the signal from a side where light from the light source unit is emitted.

7. A lighting device having a light source unit, a receiver that receives a signal for remote control, and a PWM driver that drives the light source unit according to the signal received by the receiver:

wherein the PWM driver is structured so as to perform driving by using a PWM frequency different from a frequency of the signal, wherein the PWM frequency is a frequency where it is reduced that flickering of the light source unit is viewed, wherein the light source unit includes:

a circuit board;

and a plurality of light emitting diodes mounted on the circuit board so as to be separated in a circular pattern, and the receiver is provided substantially in a center of the plurality of light emitting diodes.

8. The lighting device according to claim 7, wherein the frequency of the signal is substantially 38 kHZ, and the PWM frequency is 300 Hz to 3 kHz.

9. The lighting device according to claim 7, wherein the receiver is provided so as to receive the signal from a side where light from the light source unit is emitted.

10. A lighting device having a light source unit, a receiver that receives a signal for remote control, and a PWM driver that drives the light source unit according to the signal received by the receiver:

wherein the PWM driver is structured so as to perform driving by using a PWM frequency different from a frequency of the signal, wherein the PWM frequency is made different by separating a frequency band thereof from the frequency of the signal to an extent that interference with the frequency of the signal does not readily occur, wherein the PWM frequency is a frequency where it is reduced that flickering of the light source unit is viewed, wherein the light source unit includes:

a circuit board;

and a plurality of light emitting diodes mounted on the circuit board so as to be separated in a circular pattern, and the receiver is provided substantially in a center of the plurality of light emitting diodes.

11. The lighting device according to claim 10, wherein the frequency of the signal is substantially 38 kHZ, and the PWM frequency is 300 Hz to 3 kHz.

12. The lighting device according to claim 10, wherein the receiver is provided so as to receive the signal from a side where light from the light source unit is emitted.

* * * * *